US006785934B2

(12) United States Patent
Bruno et al.

(10) Patent No.: US 6,785,934 B2
(45) Date of Patent: Sep. 7, 2004

(54) UNIVERSAL VACUUM EXTENSION KIT

(75) Inventors: Frank L. Bruno, Colorado Springs, CO (US); Marva L. Plummer-Bruno, Colorado Springs, CO (US)

(73) Assignee: Cornice Technologies Inc, Larkspur, CO (US)

( * ) Notice: Subject to any disclaimer, the term of this patent is extended or adjusted under 35 U.S.C. 154(b) by 339 days.

(21) Appl. No.: 10/092,523

(22) Filed: Mar. 8, 2002

(65) Prior Publication Data

US 2002/0092103 A1 Jul. 18, 2002

Related U.S. Application Data

(63) Continuation-in-part of application No. 09/676,678, filed on Oct. 2, 2000, now Pat. No. 6,378,166.

(51) Int. Cl.[7] ..... A47L 9/24

(52) U.S. Cl. ..... 15/414; 15/323; 285/7; 285/12

(58) Field of Search ..... 15/323, 328, 414; 285/7, 12, 148.18, 148.23

(56) References Cited

U.S. PATENT DOCUMENTS

| | | | | |
|---|---|---|---|---|
| 2,122,633 A | * | 7/1938 | Baxter | 285/7 |
| 2,273,211 A | | 2/1942 | Martinet | |
| 2,440,143 A | * | 4/1948 | Hammell | 285/7 |
| 2,460,851 A | | 2/1949 | Sheppard | |
| 3,073,626 A | * | 1/1963 | Gasparini | 285/7 |
| 3,306,634 A | | 2/1967 | Groves et al. | |
| 3,727,949 A | * | 4/1973 | Kleykamp et al. | 285/7 |
| 3,760,430 A | * | 9/1973 | Brenden | 4/111.1 |
| 3,922,753 A | | 12/1975 | Aberilla | |
| 3,986,737 A | * | 10/1976 | Krusche | 285/341 |
| 4,053,962 A | | 10/1977 | McDowell | |
| 4,783,099 A | | 11/1988 | Muser | |
| 4,955,105 A | * | 9/1990 | Sunagawa et al. | 15/323 |
| 4,997,209 A | | 3/1991 | McGrath et al. | |
| 5,335,943 A | * | 8/1994 | Duryea | 285/12 |
| 6,378,166 B1 | * | 4/2002 | Bruno et al. | 15/414 |

FOREIGN PATENT DOCUMENTS

JP 2003-159203 * 6/2003

* cited by examiner

*Primary Examiner*—Terrence R. Till
(74) *Attorney, Agent, or Firm*—The McCallum Law Firm LLC; Jennifer M. McCallum Esq

(57) ABSTRACT

A vacuum extension kit elements includes extensions, a flexible hose and an adapter or two, each having plural diameter male and female connectors for connection to different size vacuum cleaner elements and attachments and/or an elastic adapter. The conduit through the elements is essentially a uniform diameter, for uninterrupted flow, and is small enough to double the flow velocity through standard vacuum cleaner elements. A clog preventer, for filtering out large particles, and inserts, for optional further reduction of female connector inside diameters, are also provided.

20 Claims, 3 Drawing Sheets

UNIVERSAL VACUUM EXTENSION KIT

This application is a Continuation-In-Part of application Ser. No. 09/676,678 filed Oct. 2, 2000, now U.S. Pat. No. 6,378,166.

BACKGROUND OF THE INVENTION

1. Field of the Invention

A universal vacuum cleaner extension kit extends the reach of standard cleaners.

2. Description of Related Art

Most vacuum cleaners come with some sort of extension and replacement parts. These prove to be satisfactory for the standard rooms, but do not meet the needs for high locations such as high ceilings, vaulted ceilings, high windows, and high foyers.

In the vacuum cleaner art, extensions are well known for reaching heights and for extending the horizontal reach from the collection cannister or bag. There is no universally accepted standard for tubing or connectors. However, most tubing and connectors used with vacuum cleaners vary from 1¼ inches to 1½ inches in diameter. B. Baxter (U.S. Pat. No. 2,122,633, issued Jul. 5, 1938) is an example of tubular extension sections having locking couplings between the sections. N. Okun (U.S. Pat. No. 2,801,437, issued Aug. 6, 1957) teaches a tapered male and female coupling; N. Schneider (U.S. Pat. No. 5,410,776, issued May 2, 1995) teaches small tapers for frictionally securing parts of vacuum attachments to extension tubes; and, R. McDowell (U.S. Pat. No. 4,053,962, issued Oct. 18, 1977) teaches several stepped and tapered inner surfaces for forcefully attaching a tubular vacuum cleaner section to various size nozzles, such as 1¼ and 1½ inch external diameter nozzles.

Elastic elements have been used with vacuum and air conducting conduits for various purposes. As examples, E. Martinet (U.S. Pat. No. 2,273,211, issued Feb. 17, 1942) seals air leakage by covering a joint coupling with a one-piece rubber sleeve. W. Sheppard (U.S. Pat. No. 2,460,851, issued Feb. 8, 1949) joins a connector to a bag using a molded rubber sleeve that is slightly less than the outside diameter of a tubular connector to frictionally grip it. M. Groves et al (U.S. Pat. No. 3,306,634, issued Feb. 28, 1967) uses an elastic molded sleeve to make a joint air tight with cylindrical tubular front and rear ends and a corrugated central section. W. Aberilla (U.S. Pat. No. 3,922,753, issued Dec 2, 1975) uses stretchable elongated tubes over the ends of rigid tubes for rapid joining and sealing with different diameter rigid tubes joined by using a short length collar between the smaller diameter connector and the stretchable elongated tube.

SUMMARY OF THE INVENTION

The present invention is to components that attach to most cannister and upright vacuums. To meet the special needs for extending the reach of vacuum cleaners, this invention provides extensions with a decreased uninterrupted internal diameter to increase velocity within the extensions for improved removal of dust, cobwebs and insects, an adapter joins hose extensions to different size connectors.

There are four to six extensions provided in the kit. Each extension has a male and a female plastic end connector with tapered surfaces that allow for easy slip-fit attachment to each other. The average height person with four three-foot extensions or six two-foot extensions can reach about seventeen feet in height. This allows a person to stand on one floor and vacuum the ceiling and comers of an above floor or a $2^{nd}$ level.

There is an adapter provided for connecting the extensions to existing vacuum hoses, attachments, and pipes. It is primarily used to attach an extension to vacuum units having a smaller diameter conduit.

A flexible hose extension is provided for additional flexibility and additional operator freedom when using an existing hose. The flexhose is especially useful for upright vacuum cleaners in view of the short flexible hoses used on them as compared to the cannister type. While an extension can be attached to the upright flexible hose, a very limited freedom of movement usually results. Connecting the flexible hose of the invention to the flexible hose of a vacuum cleaner adds footage and use well beyond the vacuum cleaner. A tapered or stepped female fitting can be provided on the flexhose. With it a standard or smaller diameter vacuum can be connected. The opposite end of the flexhose can be connected to the extension.

For additional flexibility an elastic adapter can be used for coupling odd-sized connectors. By deforming or stretching the adapter to fit within or over connectors, odd size connectors can be joined together.

DESCRIPTION OF THE PREFERRED EMBODIMENT

Figure 1:
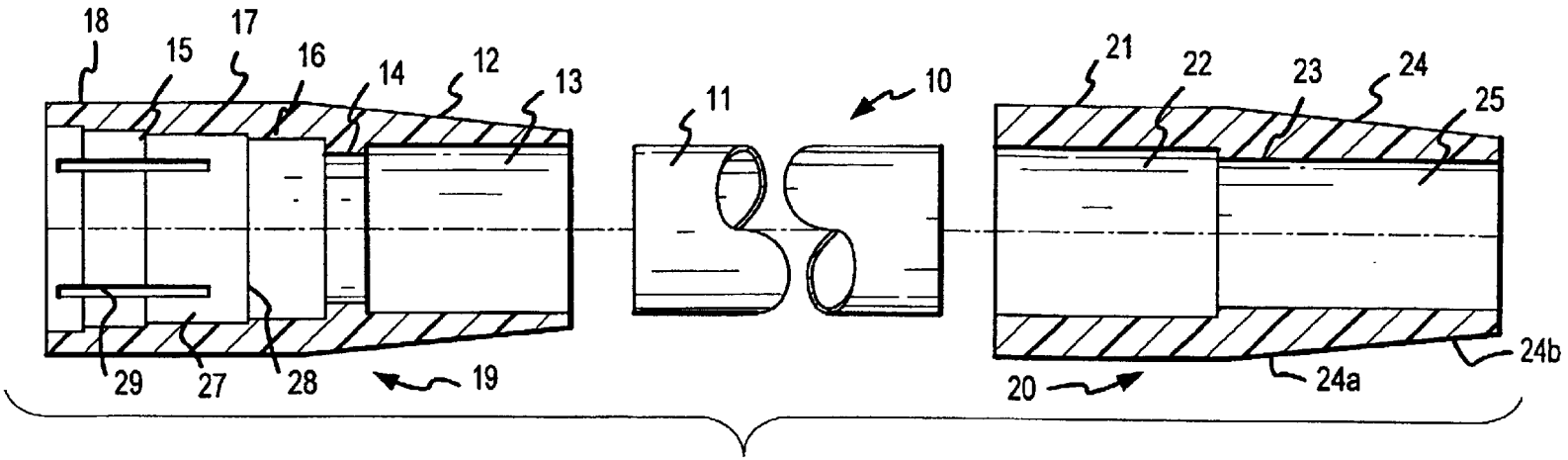
FIG. 1 is an exploded view of an extension with parts shown separated and with sectional views of the end connectors.

FIG. 1 shows an extension 10 having an elongated tube 11 with female connector 19 and male connector 20. The elongated tube has a wall thickness sufficient to make it self-supporting and capable of supporting an accessory (i.e. tool implement, etc.), other extensions, and the moderate lateral pressures used against surfaces to be cleaned. If stainless steel is used, a wall thickness of 0.01 to 0.02 inches has been found sufficient with ¾ to 1 inch diameter tubes. The female connector 19 is provided with a cylindrical opening 13 in a first end 12 to receive one first end of the elongated tube 11 with a tapered wall thickness that increases inwardly. A stop 14 is formed by having the wall thicker at a central inner location for locating the end travel of the elongated tube and strengthening the connector between the elongated tube and receiving first end 12 and an element held within the cavity 27 of the female connector second end 18. The connector second end has an inwardly decreasing diameter that can have a uniform taper, or be stepped 28, or a combination of the two, to receive standard diameter accessories or elements, or to be attached to the male end 52 of the flexhose or extensions. The inside diameter at the end 15 can be about 1½ inches, at the middle 17 1⅜ inches, and at the base 16 1¼ inches.

The male connector 20 includes a first end 21 having a cylindrical opening 22 that receives a second end of the elongated tube 11. A thicker wall 23 with a slightly smaller internal diameter 25 at the base of the cylindrical opening 22 acts as a stop for the elongated tube. The second end 24 of the male connector 20 is provided with a modest external taper that gives a slightly larger outside diameter 24*a* at the central area and a slightly smaller outside diameter 24*b* on the second end. The outside taper is also designed to engage a female connector of another extension or standard accessory or the adapter 30 so as to attach to smaller accessories.

The extensions can be made from various metal and plastic materials that offer strength, rigidity and light weight. Since the assembled extension must be strong enough to be essentially self supporting, stainless steel tubing is preferred. Most plastics have been found to be too flexible, heavy and hard to control. The end connectors or fittings are preferably ABS plastic attached to the tubing with a high strength adhesive such as CA-50 GEL sold by 3M Corporation. A ⅓ to 1 inch diameter tube has about 0.44 to 0.79 square inch of flow area, while a 1¼ to 1½ inch diameter tube has about a 1.2 to 1.8 square inch flow area. By using tubes having a diameter of from ¾ to 1 inch, the velocity within the tube is increased by about 200% and the overall weight that must be manipulated is reduced.

The end connectors or fittings are somewhat larger or thicker than those that are used in the prior art. This is to accommodate the smaller diameter tube yet allows it to fit larger diameter accessories found on some vacuum cleaner hoses and conduits. They also join the tubes such that an uninterrupted flow path extends through the tubes, when they are joined together, and gives the extensions a rigid support.

The female connectors, on their inner surfaces, and the male connectors, on their outer surfaces, can be provided with irregularities such as ridges or recesses around their circumferences or longitudinally. It has been found that a smooth surface male connector placed inside a smooth surfaced female receptor has such a hold that it is very difficult to pull them apart. This could be from a vacuum type hold created between the two. To overcome this problem, it has been found that ridges or recesses around the circumference or longitudinally on these surfaces provide the necessary grip for securing the two together while giving a reasonably easy release of the two. This use is illustrated as longitudinal recesses 29 inside female connector 19 of the extension 10 shown in FIG. 1 and as circumferential ridges 57 on male connector 52 of the flexible hose 50 shown in FIG. 5. The preferred size of these irregularities is from 0.01 to 0.02 inches in height and up to 0.12 inches in width that extend from 1 to 1½ inches in length. The irregularities can be rectangular or rounded and may be tapered along their length in any given area they are used at. The recesses and ridges are designed into the connector so as to not let air in and/or the mating connectors are designed to make contact circumferentially and the inner and/or outer end of the connectors to block air leakage.

Figure 2:
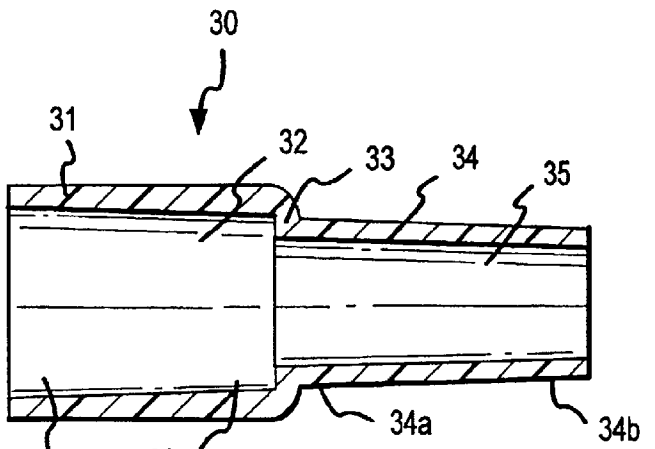
FIG. 2 is a sectional side view of the adapter.

An adapter 30 is shown in FIG. 2. The first end 31 has a cylindrical outer surface and a tapered inner opening 32. The outer opening first end 32*b* has a larger diameter than the inner opening second end 32*a* for example. This opening 32 accommodates male extensions generally ranging from 1.16 to 1.25 inches. This could be the male connector 20 of extension 10 or the male connector of some larger element or accessory. The second end 34 is joined 33 to the first end and has a passage 35 and a tapered outer wall with an inner outside diameter 34*a* that has a larger diameter than the outer end outside diameter 34*b*. The taper generally ranges from 0.09 to 1.15 inches and is designed to engage with the elements or accessories used on smaller vacuum sizes. The adapter allows the extensions, having a smaller diameter than commonly used, to connect to standard vacuums having a larger diameter, usually 1¼ to 1½ inch. Additional adapters can be provided to allow extensions to attach to accessories with smaller than standard diameters.

Figure 3:
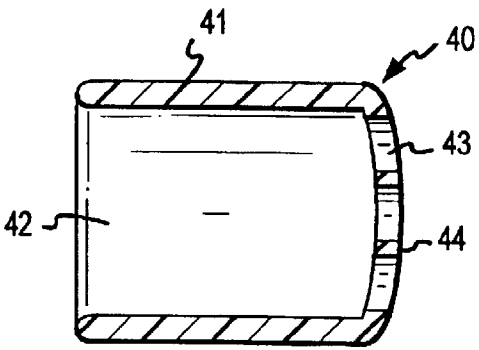
FIG. 3 is a sectional side view of a clog preventer.
Figure 4:
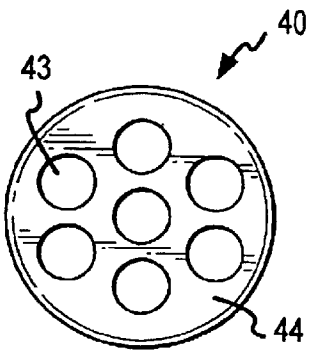
FIG. 4 is a front view of the clog preventer of FIG. 3.

FIGS. 3 and 4 show a clog preventer 40. The clog preventer can be used in areas having a large number of large particles. It is used to prevent entrance of these particles into areas that might permit clogging such as the smaller diameter flexhose and extensions. The clog preventer body 41 is similar in size and shape to the female connector end 32 of the adapter 30 of FIG. 2. A first open end gives access to area 42 that can fit over the male connector 20 second end 24 or over the male connector 52 outer surface 53. A second closed end 44 is provided with apertures 43 permitting air and small particle passage.

Figures 5, 6, 7, 8:
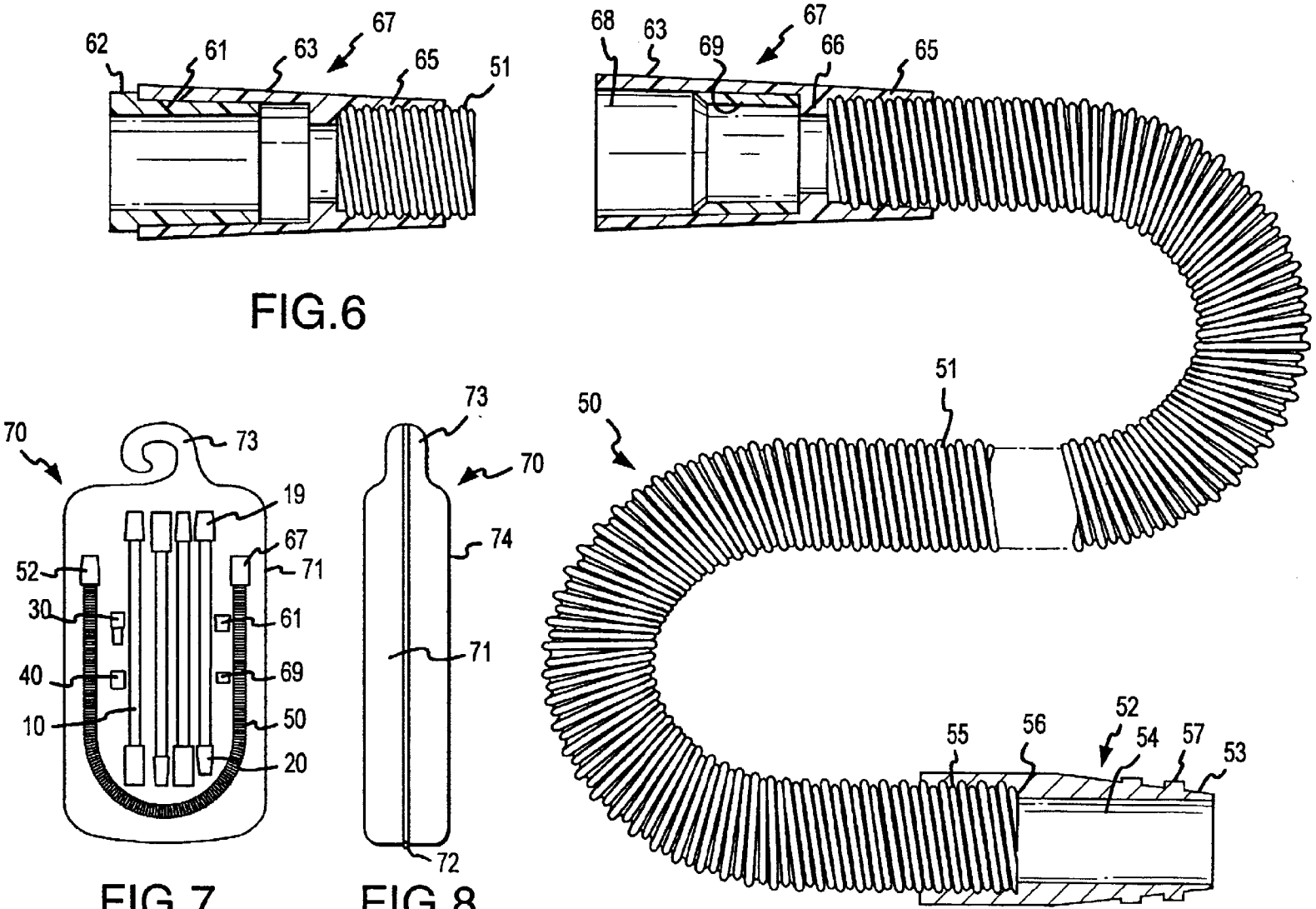
FIG. 5 is a view of a hose extension with the end connectors shown in section.
FIG. 6 is a sectional view of the female end connector of the hose extension with an alternate adapter insert.
FIG. 7 is a front view of a container housing the components of the extension kit.
FIG. 8 is a side view of the container of FIG. 7.

FIG. 5 shows a hose extension 50 provided with the present invention. The hose extension has a flexible hose 51 with an inside diameter of about 0.75 inch having a male hose connector 52 on one first end and a female hose connector 67 on the second end. The male hose connector 52 has a threaded internal recess 55 for threading in the first end of the hose although it can be permanently bonded or molded in place. A hose stop 56 limits the distance the hose can be threaded into the male hose connector. The second end of the hose connector has a tapered outer surface 53 for placement in the female connector 19 of the extension 10. As an alternative, attachments can be directly connected onto the tapered outer surface 53. The male hose connector second end has an internal passage 54 that is essentially the same diameter as the extension passage diameter.

The hose extension 50 female hose connector 67 on the hose extension second end has a threaded first end 65 that receives the hose until a stop 66 is engaged. The female hose connector second end 63 has a taper 68 with a decreasing internal diameter going from the second end toward the first end. The second end taper is designed to receive the male connector end of the vacuums. An internal recessed insert 69 can be temporarily or permanently placed within the taper 68 of the connector second end 63 if necessary to fit other vacuum cleaners with smaller connectors. The internal recessed insert reduces the diameter of the tapered recess 68 from about 1.16 to 0.09 inches. The outside diameter of the second end 63 is approximately 1.5 inches which will fit onto vacuum extensions that are larger. The plastic or rubber used to make the elements, such as the female connector 67 of FIG. 6, has enough resilience to expand or contract to accommodate slight differences existing between some vacuum cleaners.

FIG. 6 shows an optional insert for the female connector tapered second end 63 with the hose 51 threaded into the female connector first end 65. An internal outer insert 61 can be placed into the second end of the female hose connector until a shoulder 62 on the internal outer insert abuts the outer end of the female connector. The internal outer insert enables a smaller outside diameter vacuum unit to be connected to the hose extension. The internal outer insert 61 reduces the diameter of the female hose connector first end from about 1.25 to 1.15 inches. The internal outer insert can be temporarily or permanently placed on the female hose connector first end.

FIGS. 7 and 8 show the parts of the extension assembled in a container 70 for transport and storage. The kit contains from four to six extensions 10 each with a male connector 20 and female connector 19; a hose extension 50 with a male connector 52 and a female connector 67; a first adapter 30; a clog preventer 40; an outer internal insert 61; and an internal recessed insert 69 packaged as a unit. The container 70 shown is in the form of a clear plastic "clamshell," vacuum formed to house the parts of the kit for transport and storage. The clamshell container securely holds the parts that fit into a molded area storage compartment in a back side 71. A cover 74 on the front side is connected to the back side by a living hinge 72 on the bottom side of the container. The back side and front side are removably secured together by a hanger type hook 73 on the top side. The portion of the hanger on the back side 71 and front side cover 74 snap fit together to removably hold the cover in place over the back side. The hook allows the clamshell container 70 to be placed on a closet pole or hook for easy storage and forms a grip for transport.

An elastic adapter can be used for unusual or odd sized connectors. By providing an elastic adapter an essentially straight tube can be used as an adapter that can be compressed some, to fit within female connectors, and stretched, to fit over the outside diameter of larger connectors. The elastic adapter can be used to join male connectors together and can be stretched over the outside of connectors intended to be joined with a male connector. The elastic adapter can be manufactured less expensively yet fulfill the need to join components without fluid leakage.

Figure 9:
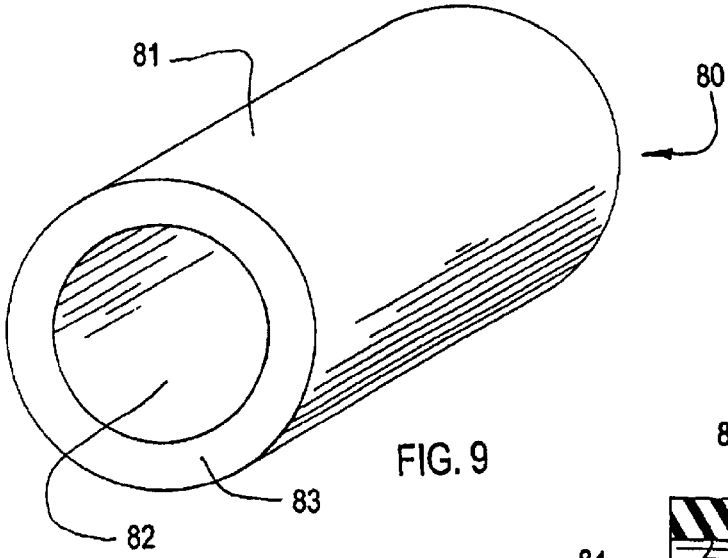
FIG. 9 is an isometric view of a simple elastic adapter.
Figure 10:
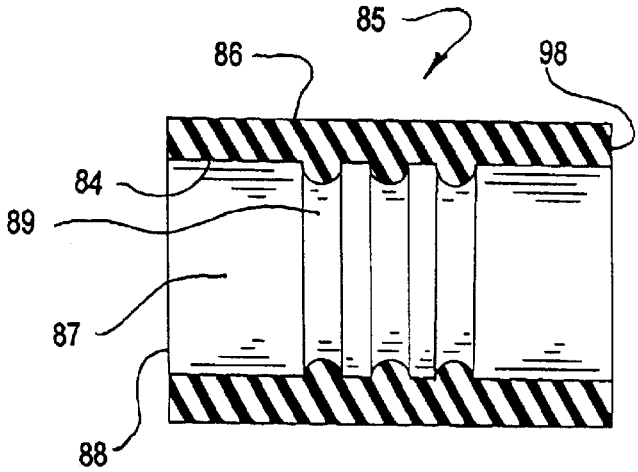
FIG. 10 is a sectional view of an elastic adapter having internal radial ridges.
Figure 11:
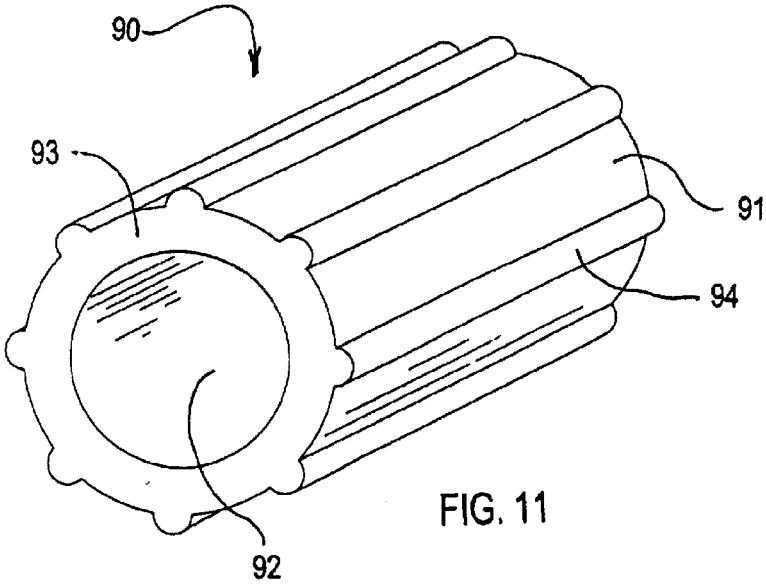
FIG. 11 is an isometric view of an elastic adapter having external longitudinal ridges.

The elastic adapter can take the form of a straight cylindrical tube 80 shown in FIG. 9, or a straight tube 85 having radial internal ridges 89 shown in FIG. 10, or a straight tube 95 having longitudinal external ribs 94 as shown in FIG. 11.

The elastic adapter straight tube 80 of FIG. 9, in its simplest form is an extruded elastomer having an inner passage 82 and a cylindrical outer surface 81. Using elastic tubes with a wall 83 thickness of ¼ inch plus or minus 1/32 inch, with inside diameters of ¾inch and/or 1 inch and/or 1¼ inch can be used. These tubes can be deformed to fit within female connectors that are up to 10% smaller than the outside diameter of the elastic adapter or up to 1/32 inch smaller than the outside diameter of the tube. The tubes can be stretched to fit over a connector that is up to twice the inside diameter of the elastic adapter. The tube can be preferably from 3½ inch to 5½ inch in length Various elastic materials can be used with one acceptable material being the compound 1200 BIKE produced by the Grab On® Products Inc. of Walla Walla, Wash.

The second flexible adapter 85 of FIG. 10 is essentially the same as the adapter 80 of FIG. 9 except that it is provided with radial ridges 89 that extend inwardly from the tube inner wall 84 into the inner passage 87. The outer wall 86 is essentially cylindrical. The radial ridges permit the adapter to couple different size connectors together as they restrict the distance the fixtures enter the adapter while centering the fixtures with respect to the adapter center and first end 88 and second end 98. The ridges also strengthen the tube against collapse. To preclude unacceptable restriction of air flow, the ridges 89 should be limited to being ⅛ inch or less.

The third flexible adapter 90 of FIG. 11 is essentially the same as the adapter 80 of FIG. 9 except that it is provided with rigidifying ridges 94 extending longitudinally on the outer surface 91. The longitudinal ridges permit the adapter to couple different size connectors together while resisting bending and preventing the collapse of the central area of the adapter between fixtures connector. A collapse would result in a restriction to air flow for any area the adapter extends into the passage 92 between connectors. The inner tube passage 92 in the tube wall 93 is uninterrupted. The ribs on the adapter are preferably 3/16 inch plus or minus 1/16 inch.

As an alternative, not shown, the adapter may have a combination of external longitudinal ridges on the outer surface and radial internal ridges near the center of the tube.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A universal vacuum extension kit comprising:

an extension having an elongated tube with a female connector on one end and a male connector on a second end;

a flexible hose having a female connector on one end and a male connector on a second end;

an elastic adapter in the general shape of a tube having a first end and a second end;

said female connector of said elongated tube and said male connector of said flexible hose are connectable together;

said elastic adapter first end and said female connector of said flexible hose are connectable together; and said elastic adapter second end being deformable and stretchable to fit different size connectors.

2. The universal vacuum extension kit as in claim 1 wherein:

said flexible hose female connector has different inside diameters along its length and said flexible hose male connector has different outside diameters along its length, to accommodate different diameter connectors; and said elongated tube female connector has different inside diameters along its length and said elongated tube male connector has different outside diameters along its length, to accommodate different diameter connectors.

3. A universal vacuum extension kit as in claim 1 wherein:

said elongated tube male connector minimum outside diameter is larger than said elongated rube diameter such that the relative cross-sectional area of said elongated tube male connector outside diameter and said elongated tube diameter double the relative velocity of air coming into said elongated tube from a source having a diameter the size of said elongated tube male connector outside diameter; and said elongated tube inside diameter, and said elongated tube male and female connectors, and said flexible hose, and said flexible hose male and female connectors all have an internal flow path when connected that provides an essentially uninterrupted flow path therethrough.

4. A universal vacuum extension kit as in claim 1 including:

a clog preventer having a first open end and a second closed end;

said second closed end having apertures that permit air and small particle passage while filtering out large particles; and said male connectors all have small irregularities placed thereon to ease the force necessary to disconnect them from their corresponding female connectors.

5. A universal vacuum extension kit as in claim 4 including:

an internal recess insert for insertion into said flexible hose female connector for reducing the inside diameter of said flexible hose female connector inside diameter to accommodate smaller male connectors.

6. A universal vacuum extension kit as in claim 4 including:

four said extensions;

a clamshell container formed to removably secure said extensions, said flexible hose, said adapter and said clog preventer for transport and storage; and said clamshell container having a storage compartment on a back side, a cover on a front side, a hook means on a top side and a hinge means on a bottom side.

7. A universal vacuum extension kit as in claim 1 wherein:

said elastic adapter second end is stretchable to fit different outside diameters up to twice the diameter of said elastic adapter inside diameter and is deformable to fit different inside diameter connectors up to 10% smaller than said elastic adapter outside diameter.

8. A universal vacuum extension kit as in claim 7 wherein:

said elastic adapter has a wall thickness of ¼ inch, plus or minus 1/32 inch, and an inside diameter of from ¾ to 1¼ inch and is 3½ to 5½ inches in length.

9. A universal vacuum extension kit as in claim 7 wherein:

said elastic adapter is provided with centrally located radial ribs that extend inwardly up to ⅛ inch to control insertion and strengthen against collapse.

10. A universal vacuum extension kits as in claim 7 wherein:

said elastic adapter is provided with longitudinal ribs around its circumference that extend along the length of said elastic adapter and protrude outwardly 3/16 inch, plus or minus 1/16 inch, to strengthen against collapse.

11. A universal vacuum extension including:

an extension having an elongated tube with a female connector on one end and a male connector on a second end;

a flexible hose having a female connector on one end and a male connector on a second end;

an elastic adapter in the general shape of a tube having a first end and a second end;

said male connector of said elongated tube and said female connector of said flexible hose are connectable together;

said elastic adapter first end and said male connector of said flexible hose are connectable together; and said second end of said elastic adapter being deformable and stretchable to fit different size connectors.

12. A universal vacuum extension kit as in claim 11 wherein:

said flexible hose male connector has different outside diameters along its length and said flexible hose female connector has different inside diameters along its length, to accommodate different diameter connectors; and said elongated tube female connector has different inside diameters along its length and said elongated tube male connector has different outside diameters along its length, to accommodate different diameter connectors.

13. A universal vacuum extension kit as in claim 11 wherein:

said elongated tube male connector minimum outside diameter is larger than said elongated tube diameter such that the relative cross-sectional area of said elongated tube connector outside diameter and said elongated tube diameter double the relative velocity of air coming into said elongated tube from a source having a diameter the size of said elongated tube male connector outside diameter; and said elongated tube inside diameter, and said elongated tube male and female connectors, and said flexible hose, and said flexible hose male and female connectors all have an internal flow path when connected that provides an essentially uninterrupted flow path therethrough.

14. A universal vacuum extension kit as in claim 11 including:

a clog preventer having a first open end and a second closed end; said second closed end having apertures that permit air and small particle passage while filtering out large particles; and said female connectors all have small irregularities placed thereon to ease the force necessary to disconnect them from corresponding male connectors.

15. A universal vacuum extension kit as in claim 14 including:

an internal recess insert for insertion into said flexible hose female connector for reducing the inside diameter of said flexible hose female connector inside diameter to accommodate smaller male connectors.

16. A universal vacuum extension kit as in claim 14 including:

four said extensions;

a clamshell container farmed to removably secure said extensions, said flexible hose, said adapter and said clog preventer for transport and storage; and said clamshell container having a storage compartment on a back side, a cover on a front side, a hook means on a top side and a hinge means on a bottom side.

17. A universal vacuum extension kit as in claim 11 wherein:

said elastic adapter second end is stretchable to fit different outside diameters up to twice the diameter of said elastic adapter inside diameter and is deformable to fit different inside diameter connectors up to 10% smaller than said elastic adapter outside diameter.

18. A universal vacuum extension kit as in claim 17 wherein:

said elastic adapter has a wall thickness of ¼ inch, plus or minus 1/32 inch, and an inside diameter of from ¾ to 1¼ inch and is 3½ to 5½ inches in length.

19. A universal vacuum extension kit as in claim 17 wherein:

said elastic adapter is provided with centrally located radial ribs that extend inwardly up to ⅛ inch to control insertion and strengthen against collapse.

20. A universal vacuum extension kit as in claim 17 wherein:

said elastic adapter is provided with longitudinal ribs around its circumference that extend along the length of said elastic adapter and protrude outwardly 3/16 inch, plus or minus 1/16 inch, to strengthen against collapse.

* * * * *